US008308614B2

(12) United States Patent
Chiu et al.

(10) Patent No.: US 8,308,614 B2
(45) Date of Patent: Nov. 13, 2012

(54) REHABILITATION DEVICE FOR ARMS

(75) Inventors: Ching-Hua Chiu, Taichung (TW); Li-Wei Chou, Taichung (TW)

(73) Assignee: China Medical University, Taichung (TW)

( * ) Notice: Subject to any disclaimer, the term of this patent is extended or adjusted under 35 U.S.C. 154(b) by 474 days.

(21) Appl. No.: 12/753,848

(22) Filed: Apr. 2, 2010

(65) Prior Publication Data

US 2011/0245038 A1 Oct. 6, 2011

(51) Int. Cl.
*A63B 71/00* (2006.01)

(52) U.S. Cl. ..... 482/8; 482/44

(58) Field of Classification Search ..... 482/2, 44, 482/45, 46, 47, 48, 49, 50, 83, 138; 434/259, 434/260, 261

See application file for complete search history.

(56) References Cited

U.S. PATENT DOCUMENTS 3,804,406 A * 4/1974 Viscione ..... 482/4
4,353,545 A * 10/1982 Anderson ..... 482/4
4,822,027 A * 4/1989 Kascak ..... 482/46
5,156,549 A * 10/1992 Wehrell ..... 434/258
5,472,395 A * 12/1995 Trocchio ..... 482/83
6,432,027 B1 * 8/2002 Haselrig ..... 482/83
6,872,171 B2 * 3/2005 Haselrig ..... 482/83
7,086,997 B1 * 8/2006 Fields et al. ..... 482/90
7,416,517 B2 * 8/2008 Mitchell ..... 482/90
2004/0176222 A1 * 9/2004 Mitchell ..... 482/83
2007/0142186 A1 * 6/2007 Macnab ..... 482/83
2008/0254950 A1 * 10/2008 Beliles ..... 482/83

* cited by examiner

*Primary Examiner* — Loan Thanh
*Assistant Examiner* — Shila Jalalzadeh Abyane
(74) *Attorney, Agent, or Firm* — Hershkovitz & Associates LLC; Abe Hershkovitz

(57) ABSTRACT

A rehabilitation device for arms has an operating module, a control module and an inductive module. The operating module has a base, a body and multiple operating segments. The operating segments are connected to the body and each has a lever, a resisting panel and a resisting device. The control module is connected to the operating module and has a switch, a microcomputer, a resistance controller, an import interface, an export interface and a monitor. The resisting control device is electrically connected to the microcomputer and the operating segments. The inductive module is electrically connected to the operating module and the control module and has an inductive segment and a counter segment. The inductive segment is electrically connected to the microcomputer and has multiple pressure sensors. The counter segment is electrically connected to the inductive segment and the microcomputer and has multiple photoelectric sensors.

10 Claims, 7 Drawing Sheets

REHABILITATION DEVICE FOR ARMS

BACKGROUND OF THE INVENTION

1. Field of the Invention

The present invention relates to a rehabilitation device, and more particularly to a rehabilitation device for arms that is interesting and rehabilitative.

2. Description of the Prior Arts

With improvements of technology, when disease or accidents reduce mobility, rehabilitation can aid recover. Conventional rehabilitation devices are mechanical structures and linkage shafts to simulate exercise dynamics and patients can exercise and train their body by the conventional rehabilitation devices.

Although the conventional rehabilitation devices can provide a rehabilitation effect for patients, the conventional rehabilitation devices only provide a single function and lack versatility of use. Thus, causing boredom or frustration, so detracting from exercise.

To overcome the shortcomings, the present invention provides a rehabilitation device for arms to mitigate or obviate the aforementioned problems.

SUMMARY OF THE INVENTION

The main objective of the present invention is to provide a rehabilitation device, and more particularly to a rehabilitation device for arms that is interesting and rehabilitative.

The rehabilitation device for arms in accordance with the present invention has an operating module, a control module and an inductive module. The operating module has a base, a body and multiple operating segments. The operating segments are connected to the body and each has a lever, a resisting panel and a resisting device. The control module is connected to the operating module and has a switch, a microcomputer, a resistance controller, an import interface, an export interface and a monitor. The resisting control device is electrically connected to the microcomputer and the operating segments. The inductive module is electrically connected to the operating module and the control module and has an inductive segment and a counter segment. The inductive segment is electrically connected to the microcomputer and has multiple pressure sensors. The counter segment is electrically connected to the inductive segment and the microcomputer and has multiple photoelectric sensors.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
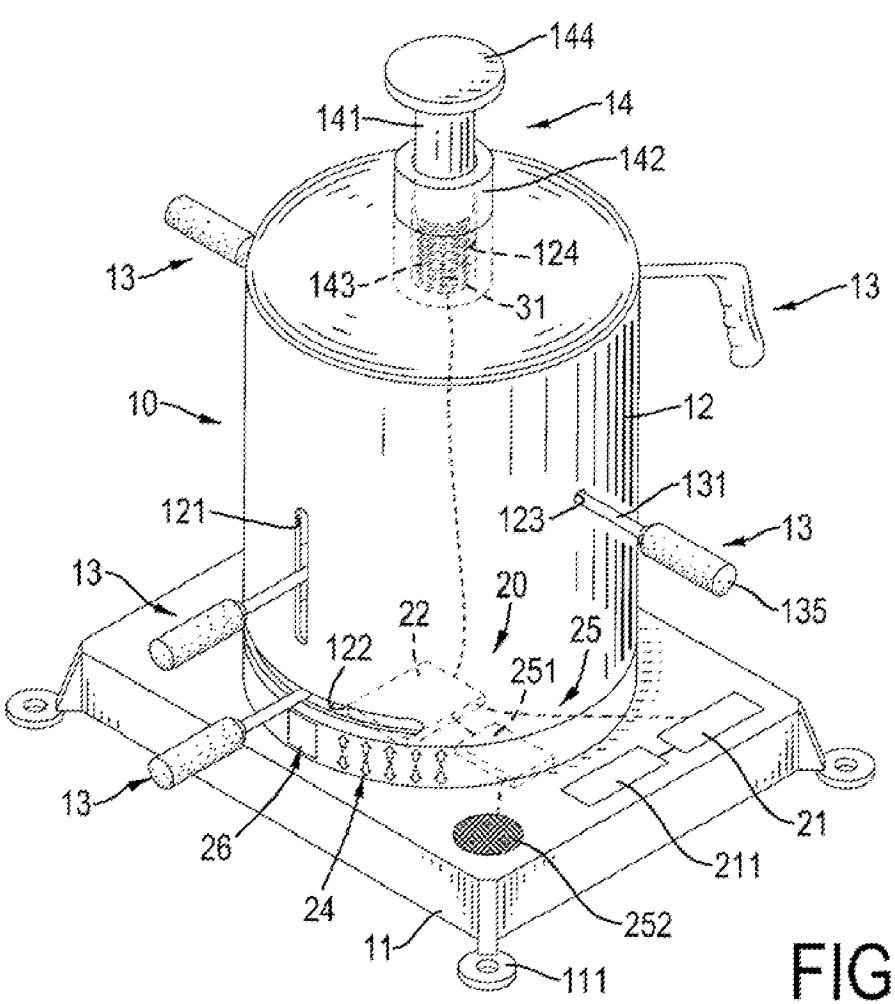
FIG. 1 is a perspective view of a rehabilitation device in accordance with the present invention.
Figure 2:
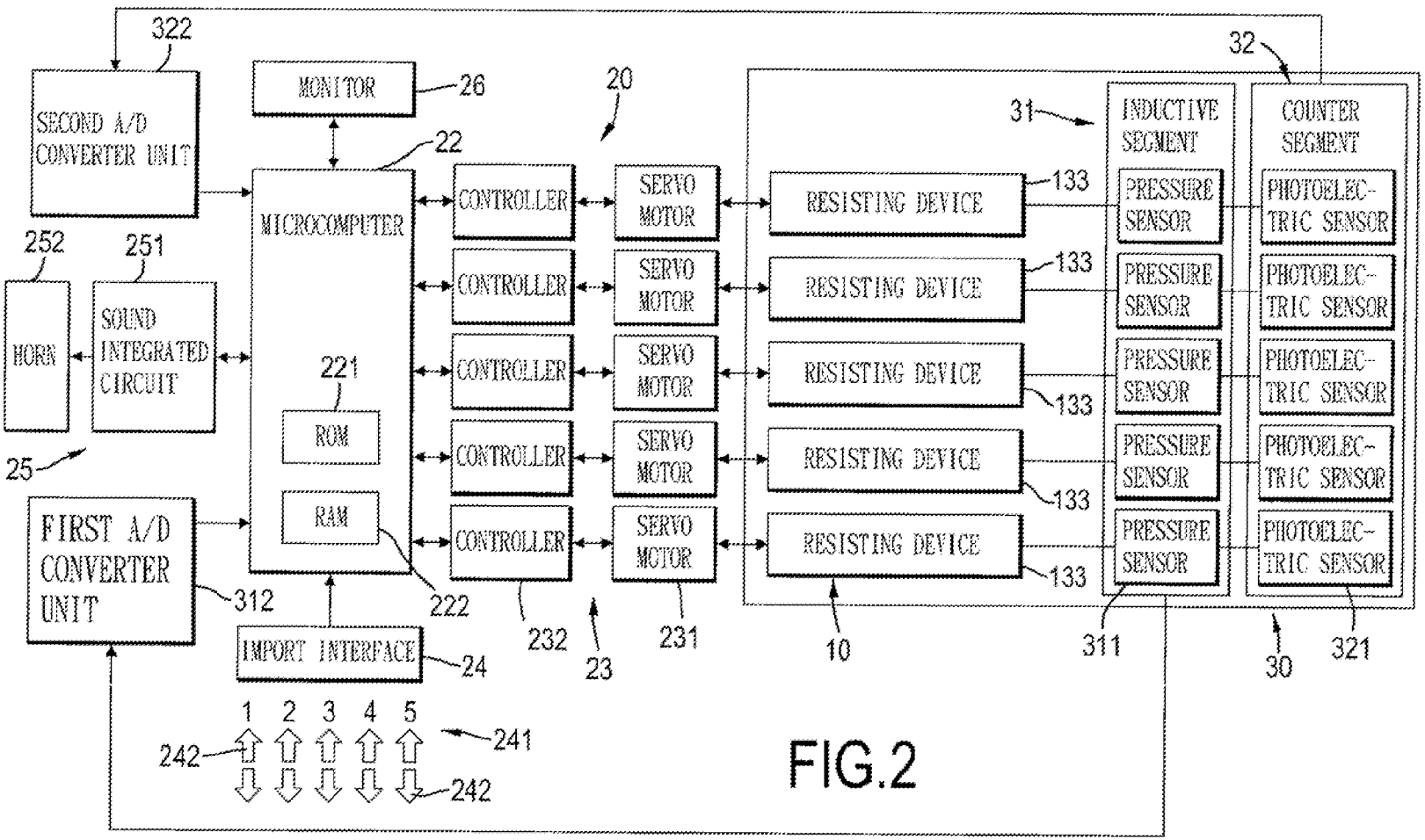
FIG. 2 is an electric block diagram of the rehabilitation device in FIG. 1.
Figure 3:
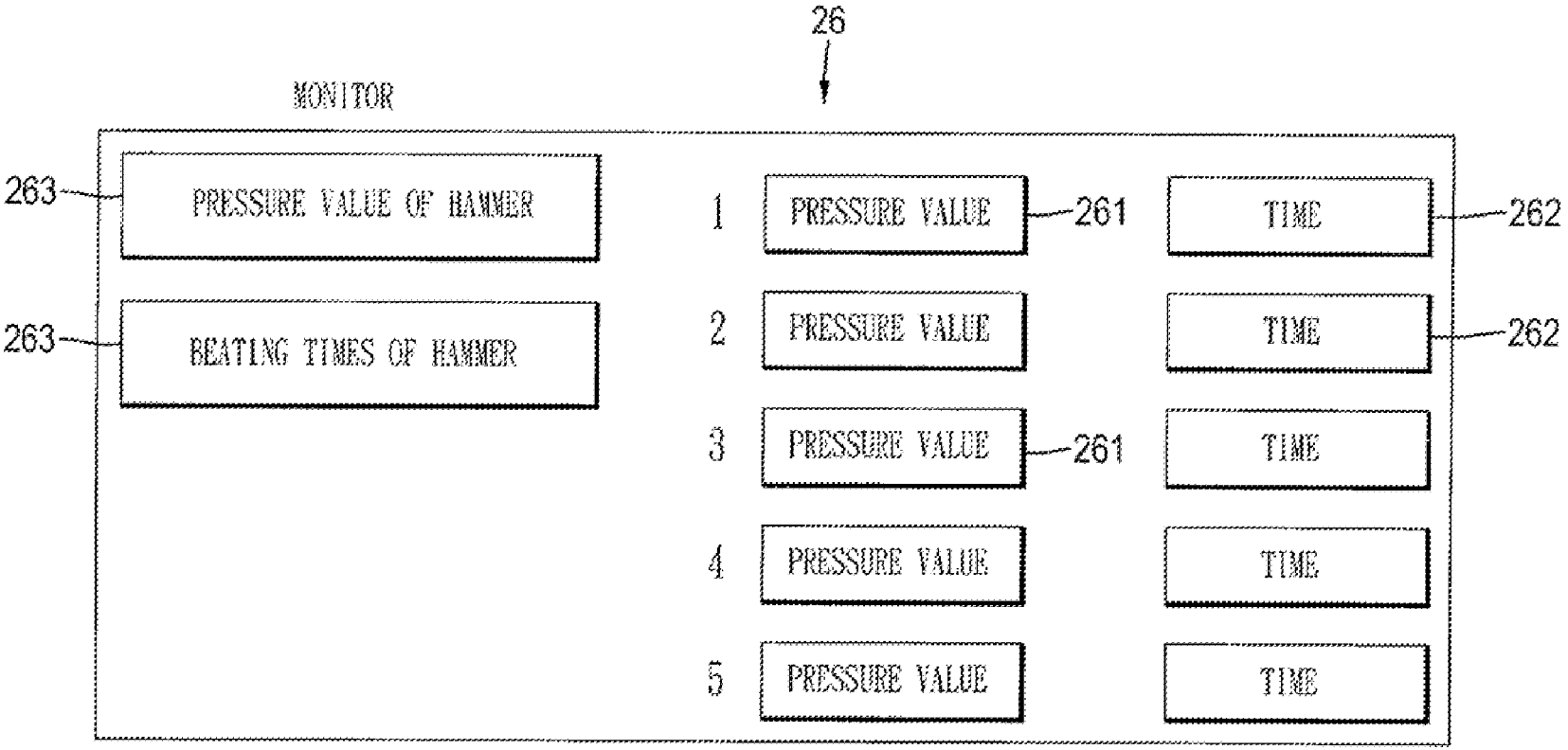
FIG. 3 is a side view of a monitor of the rehabilitation device in FIG. 1.

With reference to FIGS. 1 to 3, a rehabilitation device for arms in accordance with the present invention comprises an operating module (10), a control module (20) and an inductive module (30).

The operating module (10) has a base (11), a body (12), multiple operating segments (13) and a beating segment (14).

The base (11) may be quadrate and has a top face, multiple corners and multiple holding rings (111). The holding rings (111) are respectively formed on the corners of the base (11) to hold the base (11) on the ground or a table.

The body (12) may be a hollow tube, is mounted on the top face of the base (11) and has an external surface, a top, a bottom, a longitudinal slot (121), a transverse slot (122), multiple through holes (123) and a mounting chamber (124). The longitudinal slot (121) is formed through the external surface of the body (12). The transverse slot (122) is formed through the external surface of the body (12) between the longitudinal slot (121) and the bottom of the body (12). The through holes (123) are formed through the external surface of the body (12). Preferably, the body (12) has three through holes (123) formed through the external surface of the body (12). The mounting chamber (124) is formed in the top of the body (12).

Figure 4:
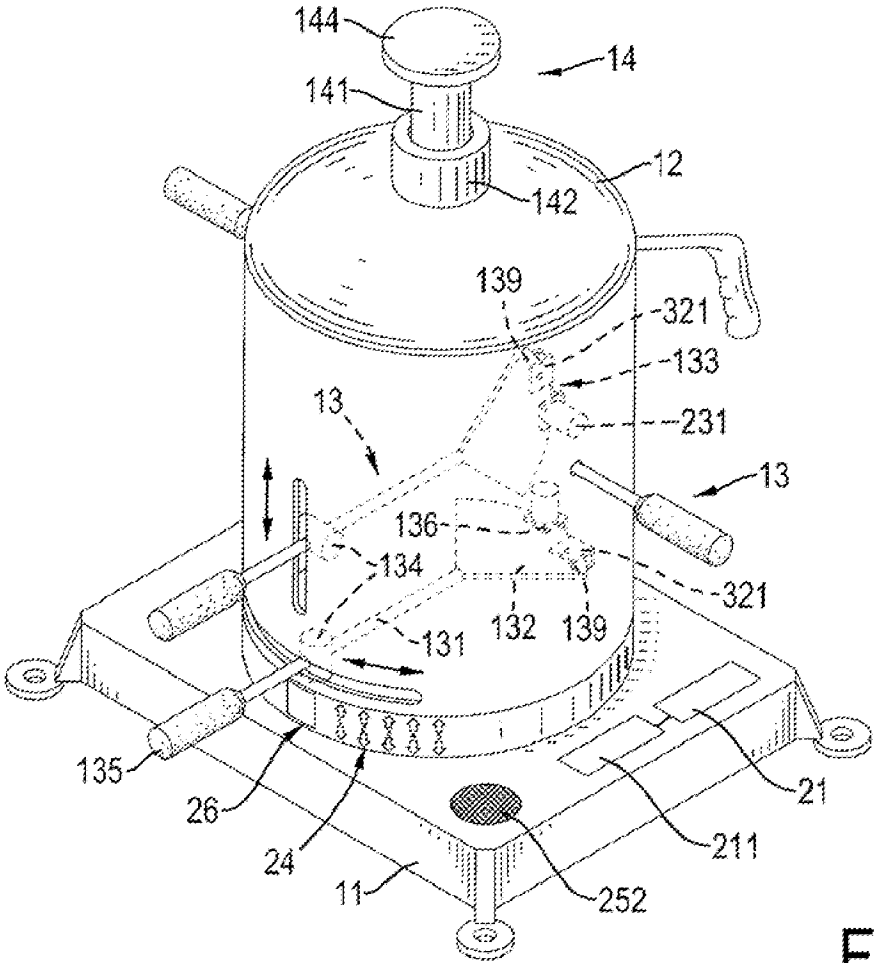
FIGS. 4, 5, 6, and 7 are operational perspective views of the rehabilitation device in FIG. 1.
Figure 5:
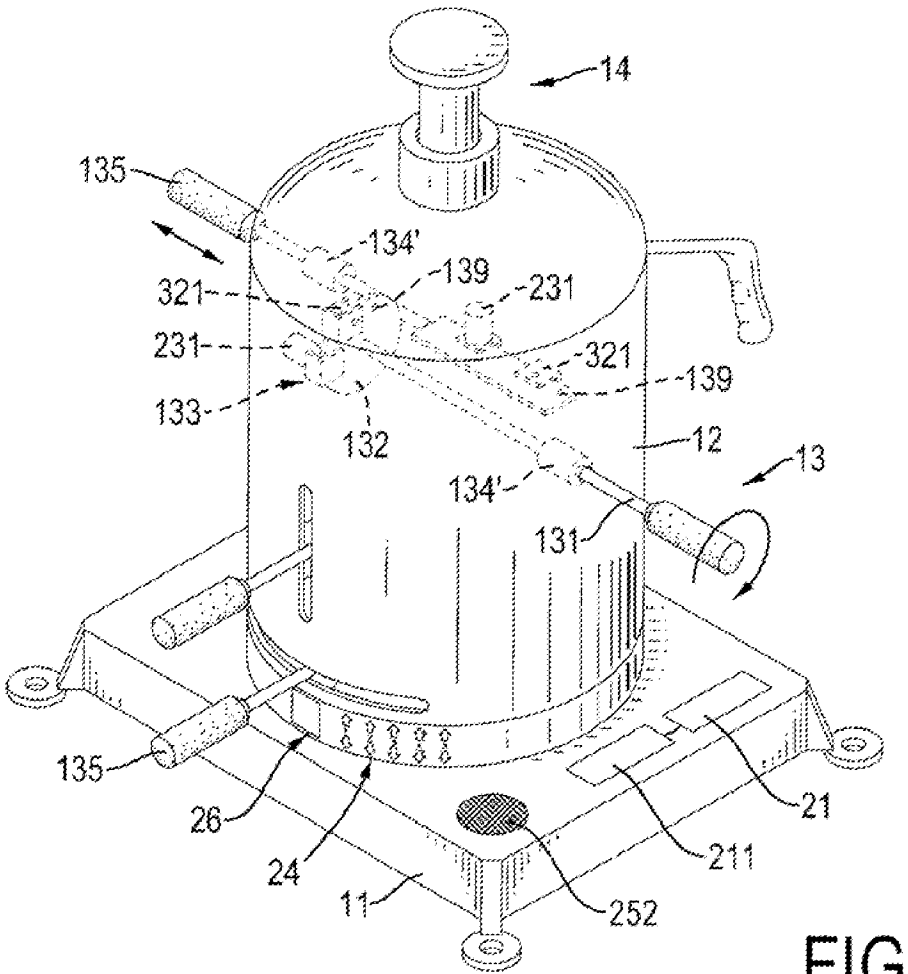
Figure 6A:
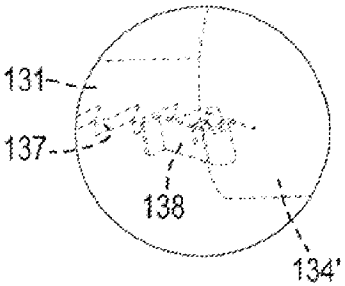
FIG. 6A is an enlarged perspective view of a resisting panel in FIG. 6.
Figure 6:
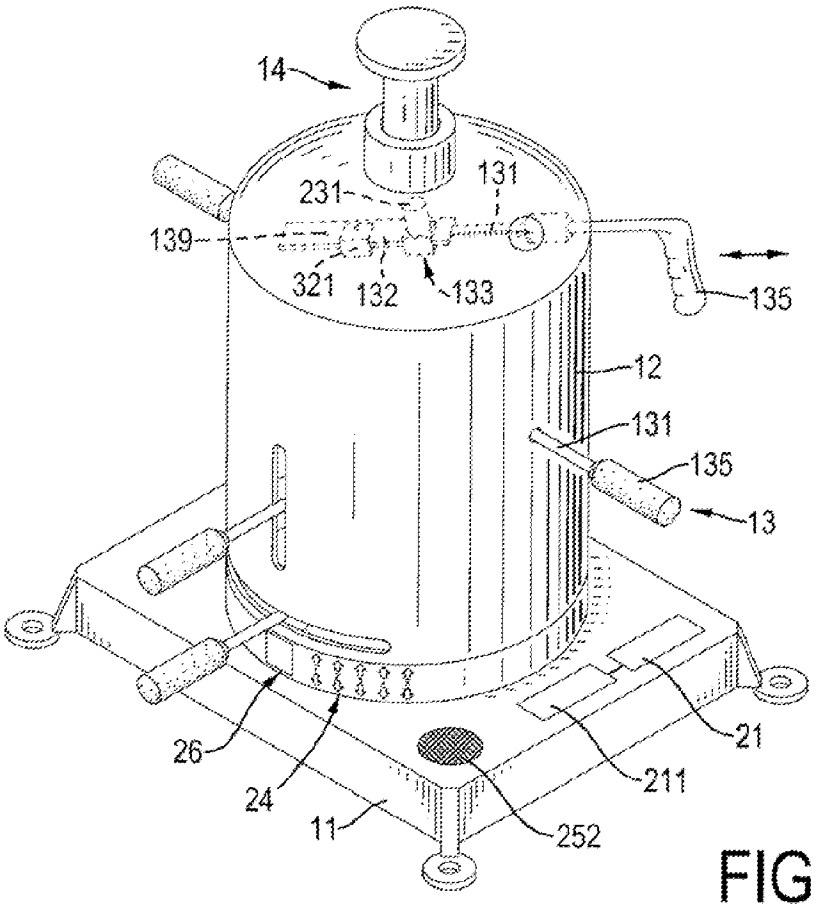
Figure 7:
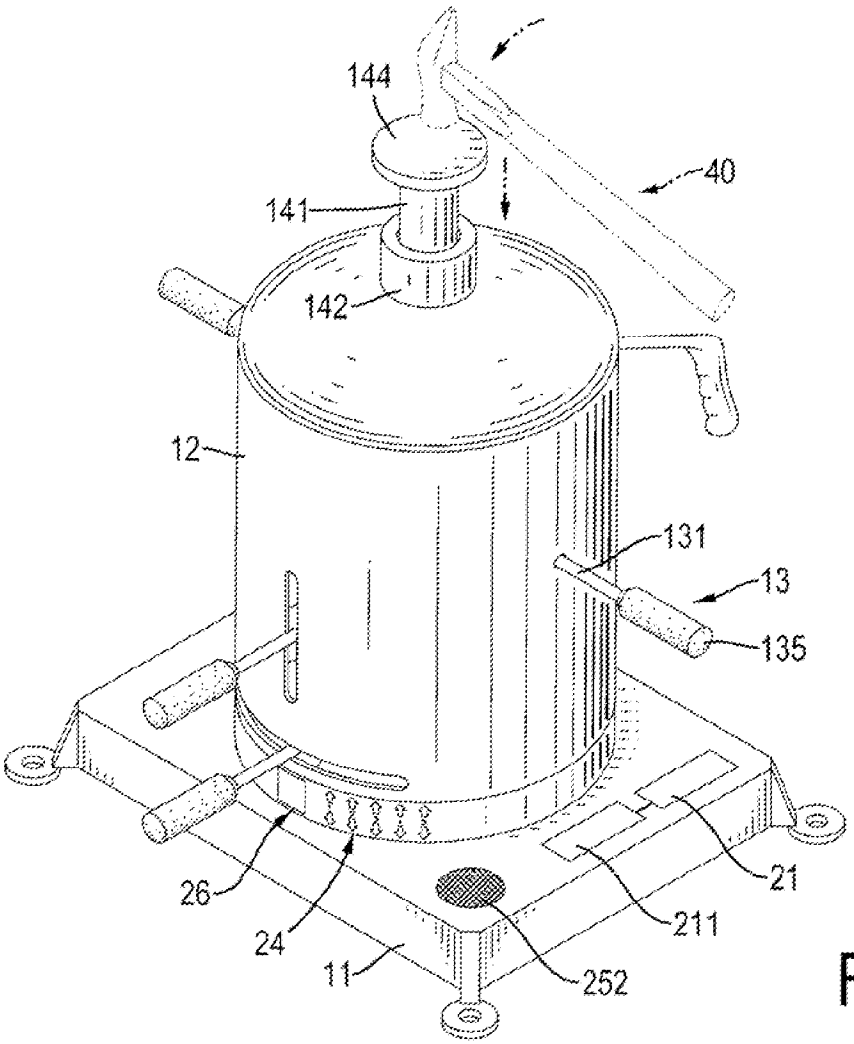

With reference to FIGS. 4 to 6, the operating segments (13) are connected to the body (12) and each operating segment (13) has a lever (131), a resisting panel (132) and a resisting device (133).

The lever (131) is connected to the body (12) and has an inner end, an outer end, a connecting unit (134, 134') and a grip (135). The inner end of the lever (131) is mounted in the body (12) via the longitudinal slot (121), the transverse slot (122) or one of the through holes (123). The outer end of the lever (131) extends out of the external surface of the body (12). The connecting unit (134, 134') may be a pivotal shaft (134) or a mounting jacket (134'), is mounted around the lever (131) and is connected to the body (12) to let the lever (131) move or rotate relative to the longitudinal slot (121), the transverse slot (122) or the through holes (123). The grip (135) is mounted around the outer end of the lever (131). Preferably, with reference to FIG. 6A, the lever (131) further has multiple saw teeth (137) and an elastic slice (138). The saw teeth (137) are formed on a sidewall of the lever (131). The elastic slice (138) is pivotally connected to the mounting jacket (134') and engages with the saw teeth (137).

The resisting panel (132) may be sectorial, rectangular or circular, is formed on the inner end of the lever (131) and has an inductive hole (139). The inductive hole (139) is formed through the resisting panel (132). The resisting device (133) is securely mounted in the body (12) and has two clamping arms (136). The clamping arms (136) of the resisting device (133) respectively abut against the sidewalls of the resisting panel (132).

The beating segment (14) is mounted in the mounting chamber (124) of the body (12) and has a beating rod (141), a cover (142), a spring (143) and a beating board (144). The beating rod (141) is movably mounted in the mounting chamber (124) of the body (12) and has a top end and a bottom end. The cover (142) is mounted securely on the top of the body (12) and the top end of the beating rod (141) and extends out of the cover (142). The spring (143) is mounted in the mounting chamber (124) of the body (12) and abuts against the bottom end of the beating rod (141). The beating board (144) is formed on the top end of the beating rod (141).

The control module (20) is connected to the operating module (10) and has a switch (21), a microcomputer (22), a resistance controller (23), an import interface (24), an export interface (25) and a monitor (26).

The switch (21) is mounted on the top face of the base (11). Preferably, the switch (21) has a battery (211) mounted on the top face of the base (11) to supply electric power. The microcomputer (22) is electrically connected to the switch (21) and is mounted on the top face of base (11) in the body (12). Preferably, the microcomputer (22) has a read only memory (ROM) (221) and a random access memory (RAM) (222).

The resisting control device (23) is electrically connected to the microcomputer (22) and the operating segments (13) and has multiple servo motors (231) and multiple controllers (232). The servo motors (231) are respectively mounted on the resisting devices (133) of the operating segments (13) to change the distance between the clamping arms (136) and to provide different resistance forces to the resisting panels (132). The controllers (232) are electrically connected to the microcomputer (22) and are electrically and respectively connected to the servo motors (231) to drive the servo motors (231).

The import interface (24) is securely mounted on the external surface of the body (12) near the bottom, is electrically connected to the microcomputer (22) and has multiple adjusters (241). The adjusters (241) are electrically connected to the microcomputer (22), are electrically and respectively connected to the operating segments (13) to adjust the resistance forces between the resisting panels (132) and the resisting devices (133) and each adjuster (241) has two buttons (242). One of the buttons (242) is used to increase the resistance force of a corresponding operating segment (13), and the other button is used to decrease the resistance forces of the corresponding operating segment (13).

The export interface (25) is mounted on the top face of the base (11), is electrically connected to the microcomputer (22) and has a sound integrated circuit (251) and a horn (252). The sound integrated circuit (251) is mounted on the top face of the base (11) in the body (12) and is electrically connected to the microcomputer (22). The horn (252) is mounted on the top face of the base (11) and is electrically connected to the sound integrated circuit (251).

The monitor (26) is securely mounted on the external surface of the body (12) near the import interface (24), is electrically connected to the microcomputer (22) and has multiple windows (261), multiple screens (262) and two displays (263). The windows (261) are mounted on the monitor (26) and are respectively used to show resistance forces of the operating segments (13). The screens (262) are mounted on the monitor (26) and are respectively used to show operating times of the levers (131). The displays (263) are mounted on the monitor (26) and are respectively to show pressure and time of the beating segment (14).

The inductive module (30) is electrically connected to the operating module (10) and the control module (20) and has an inductive segment (31) and a counter segment (32). The inductive segment (31) is mounted in the mounting chamber (124) of the body (12), is electrically connected to the microcomputer (22) and has multiple pressure sensors (311) and a first A/D converter unit (312). The pressure sensors (311) are electrically connected to the resisting devices (133) of the operating segments (13) to detect the resistance forces. The first A/D converter unit (312) is electrically connected to the pressure sensors (311) and the microcomputer (22) to transform the resistance forces as signals to the microcomputer (22). The resistance force values will show on the windows (261) of the monitor (26).

The counter segment (32) is electrically connected to the inductive segment (31) and the microcomputer (22) and has multiple photoelectric sensors (321) and a second A/D converter unit (322). The photoelectric sensors (321) are mounted in the body (12), are respectively mounted beside the inductive holes (139) of the resisting panels (132) to detect the operating times of the levers (131). The second A/D converter unit (322) is electrically connected to the photoelectric sensors (321) and the microcomputer (22) to transform the resistance forces as signals to the microcomputer (22). The operating times of the levers (131) will show on the screens (262) of the monitor (26).

In operation, with reference to FIGS. 4 to 7, when a user or patient uses the rehabilitation device in accordance with the present invention to train arms, the switch (21) and buttons (242) of the adjusters (241) are adjusted to set the resistance forces of the resisting devices (133) of the operating segments (13) and show the resistance force values on the windows (261) of the monitor (26). Then, the user or patient can train their arms by moving or rotating the levers (131) relative to the slots (121, 122) and through holes (123) of the body (12) to simulate working conditions such as using a screwdriver or a saw. In addition, the elastic slice (138) that engages with the saw teeth (137) on the corresponding lever (13) can provide a sawing sound when the lever is moved relative to the body (12).

Furthermore, the counter segment (32) can record the operating times of the levers (131) by the photoelectric sensors (32) detecting the moving times of the resisting panels (132) relative to the resisting devices (133). The operating times of the levers (131) can be respectively shown on the screens (262) of the monitor (26) and the horn (252) can remind users of the operating times of the levers (131) via the export interface (25).

Further, the user or patient can grasp a hammer (40) to beat the beating board (144) of the beating segment (14) to simulate the working condition. When the hammer (40) beats the beating board (144), the beating rod (141) will move downward relative to the cover (142) and the pressure and the times of the beating segment (14) will be respectively shown on the displays (263) via the inductive segment (31) and the microcomputer (22).

The rehabilitation device for arms in accordance with the present invention can provide different working conditions by the levers (131) of the operating segments (13) moving or rotating relative to the body (12) and the beating segment (14) to train arms. Then, users or patients can operate the rehabilitation device in different ways by the operating segments (13) and the beating segment (14). In addition, the operation of the rehabilitation device is versatile to attract users to continuously use it. Furthermore, the users can adjust the resistance forces of the resisting devices (133) by the adjusters (241) of the import interface (24) and the operating data can be recorded in the microcomputer (22) and can be shown on monitor (26).

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A rehabilitation device for arms comprising an operating module having a base having a top face;

a body mounted on the top face of the base and having
an external surface;
a top;
a bottom;
a longitudinal slot formed through the external surface of the body;
a transverse slot formed through the external surface of the body between the longitudinal slot and the bottom of the body; and
multiple through holes formed through the external surface of the body; and multiple operating segments connected to the body and each operating segment having
a lever connected to the body and having
an inner end mounted in the body via the longitudinal slot, the transverse slot or one of the through holes; and
an outer end extending out of the external surface of the body;
a resisting panel formed on the inner end of the lever and having an inductive hole formed through the resisting panel; and
a resisting device securely mounted in the body and having two clamping arms respectively abutted against the sidewalls of the resisting panel;

a control module connected to the operating module and having
a switch mounted on the top face of the base;
a microcomputer electrically connected to the switch and mounted on the top face of base in the body;
a resistance controller electrically connected to the microcomputer and the operating segments;
an import interface securely mounted on the external surface of the body near the bottom, electrically connected to the microcomputer and having multiple adjusters electrically connected to the microcomputer and electrically and respectively connected to the operating segments to adjust the resistance forces between the resisting panels and the resisting devices;
an export interface mounted on the top face of the base and electrically connected to the microcomputer; and
a monitor securely mounted on the external surface of the body near the import interface, electrically connected to the microcomputer and having
multiple windows mounted on the monitor respectively to show the resistance forces of the operating segments; and
multiple screens mounted on the monitor respectively to show the operating times of the levers; and an inductive module electrically connected to the operating module and the control module and having
a counter segment electrically connected to the inductive segment and the microcomputer and having multiple photoelectric sensors mounted in the body, respectively mounted beside the inductive holes of the resisting panels to detect the operating times of the levers.

2. The rehabilitation device as claimed in claim 1, wherein the body has a mounting chamber formed in the top of the body;

the operating module has a beating segment mounted in the mounting chamber, and the beating segment has
a beating rod movably mounted in the mounting chamber of the body and having a top end and a bottom end;
a cover mounted securely on the top of the body and the top end of the beating rod extending out of the cover;
a spring mounted in the mounting chamber of the body and abutting against the bottom end of the beating rod; and
a beating board formed on the top end of the beating rod;

the monitor has two displays mounted on the monitor respectively to show a pressure and a plurality of times of the beating segment;

the inductive module has an inductive segment mounted in the mounting chamber of the body, electrically connected to the microcomputer and having
multiple pressure sensors electrically connected to the resisting devices of the operating segments to detect the resistance forces; and
a first A/D converter unit electrically connected to the pressure sensors and the microcomputer to transform the resistance forces as signals to the microcomputer and the resistance force values shown on the windows of the monitor; and the counter segment has a second A/D converter unit electrically connected to the photoelectric sensors and the microcomputer to transform the resistance forces as signals to the microcomputer and the operating times of the levers show on the screens of the monitor.

3. The rehabilitation device as claimed in claim 2, wherein the resisting control device has
multiple servo motors respectively mounted on the resisting devices of the operating segments to change the distance between the clamping arms and to provide different resistance forces to the resisting panels; and
multiple controllers electrically connected to the microcomputer and electrically and respectively connected to the servo motors to drive the servo motors.

4. The rehabilitation device as claimed in claim 3, wherein the export interface has
a sound integrated circuit mounted on the top face of the base in the body and electrically connected to the microcomputer; and
a horn mounted on the top face of the base and electrically connected to the sound integrated circuit; and each lever has a connecting unit mounted around the lever and connected to the body to let the lever move or rotate relative to the longitudinal slot, the transverse slot or the through holes.

5. The rehabilitation device as claimed in claim 4, wherein the base has
multiple corners; and
multiple holding rings respectively formed on the corners of the base to hold the base;

each lever has a grip mounted around the outer end of the lever;

the switch has a battery mounted on the top face of the base to supply electric power;

the microcomputer has a read only memory and a random access memory; and each adjuster has two buttons, one of the buttons is used to increase the resistance force of a corresponding operating segment, and the other button is used to decrease the resistance forces of the corresponding operating segment.

6. The rehabilitation device as claimed in claim 5, wherein the connecting unit is a mounting jacket.

7. The rehabilitation device as claimed in claim 6, wherein one of the levers has
multiple saw teeth formed on a sidewall of the lever; and
an elastic slice pivotally connected to the mounting jacket and engaging with the saw teeth.

8. The rehabilitation device as claimed in claim 6, wherein two of the resisting panels are rectangular form and one resisting panel is circular form.

9. The rehabilitation device as claimed in claim 5, wherein the connecting unit is a pivotal shaft.

10. The rehabilitation device as claimed in claim 9, wherein the resisting panel is sectorial.

* * * * *